US006322465B1

(12) United States Patent
Gentile

(10) Patent No.: US 6,322,465 B1
(45) Date of Patent: Nov. 27, 2001

(54) BALL PIT BALL WITH DESICCANT

(76) Inventor: Robert Gentile, 30 Wyman Rd., Billerica, MA (US) 01821

( * ) Notice: Subject to any disclaimer, the term of this patent is extended or adjusted under 35 U.S.C. 154(b) by 0 days.

(21) Appl. No.: 09/480,293

(22) Filed: Jan. 10, 2000

(51) Int. Cl.[7] ..... A63B 39/00
(52) U.S. Cl. ..... 473/594
(58) Field of Search ..... 473/577, 594, 473/595, 596, 610

(56) References Cited

U.S. PATENT DOCUMENTS

| | | | | |
|---|---|---|---|---|
| 2,301,506 | | 11/1942 | Bean . | |
| 2,645,486 | | 7/1953 | Monahan . | |
| 2,670,206 | | 2/1954 | Brewster . | |
| 3,734,498 | * | 5/1973 | Seiersen | 473/594 |
| 4,139,195 | * | 2/1979 | Dreesen et al. | 473/550 |
| 4,448,418 | | 5/1984 | McNeill . | |
| 4,830,370 | * | 5/1989 | Schlesinger | 473/577 |
| 4,872,676 | | 10/1989 | Townsend . | |
| 5,190,504 | * | 3/1993 | Scatterday | 473/594 |
| 5,393,054 | * | 2/1995 | Rouffer | 473/594 |
| 5,516,098 | | 5/1996 | Aiello . | |
| 5,722,906 | | 3/1998 | Gentile . | |
| 5,891,000 | * | 4/1999 | Phillips | 473/594 |
| 5,924,942 | | 7/1999 | Gentile . | |
| 6,123,632 | * | 9/2000 | Feeney et al. | 473/596 |

OTHER PUBLICATIONS

Sun Hockey, Zero Bounce, Zero Ball, Street Hockey Ball (Product Description), Sun Hockey Website (www.sunhockey.com), Sun Hockey (US), (Apr. 1, 1998).

* cited by examiner

*Primary Examiner*—Steven Wong
(74) *Attorney, Agent, or Firm*—O'Connell Law Firm

(57) ABSTRACT

A ball pit ball for use in ball pits or seas of balls with desiccant for absorbing moisture from a surface of the ball pit ball and from neighboring surfaces. The ball pit ball has a generally spherical hollow outer shell defining an open inner volume with a volume of desiccant material, such as calcium chloride, in the open inner volume of the outer shell. The desiccant material can be liquid, such as calcium chloride brine, or solid and can comprise one or more desiccant materials in combination. A volume of chlorine may be further disposed in the open inner volume of the ball pit ball, possibly with a proportion of two parts chlorine to one part calcium chloride.

20 Claims, 2 Drawing Sheets

BALL PIT BALL WITH DESICCANT

FIELD OF THE INVENTION

The present invention relates generally to desiccant containers. Stated more particularly, disclosed herein is a ball pit ball with desiccant for use within ball pits, which are also known as "seas of balls," and similar circumstances for the purpose of absorbing moisture and thus better protecting children and other users by inhibiting the formation and generation of bacteria and fungi.

BACKGROUND OF THE INVENTION

It will be appreciated at the outset that a wide variety of devices and arrangements have been disclosed that employ a desiccant material to absorb water vapor, liquid water, and other liquid. For example, U.S. Pat. No. 3,326,810 issued Jun. 20, 1967 to Dolan discloses a non-dusting silica desiccant bag that is created by nylon mesh bonded to microporous polyurethane. Another desiccant device is disclosed by Cullen et al. in U.S. Pat. No. 4,783,206, which was issued Nov. 8, 1988. Cullen describes an elongated, hollow, and moisture impermeable cylindrical body fabricated of polyethylene, polyester or polypropylene having end caps constructed of spun-bonded polyolefin that allow moisture to pass. A still further drying arrangement is disclosed in U.S. Pat. No. 2,638,179 to Yard, where the desiccant material, which is contained within a capsule, absorbs moisture from a gelatin skin, and not directly from the outside atmosphere.

Still further, U.S. Pat. No. 4,665,050 to Degen et al. Discloses sorbent particles that are immobilized within a solid matrix of softened thermoplastic material such as polyethylene or polypropylene, where moisture is transmitted into the sorbent lying on the surface of the thermoplastic. More recently, a desiccant entrained polymer, formed by the blending of a polymer, such as polypropylene and polyethylene, a desiccating agent, and a channeling agent, such as ethylene-vinyl alcohol and polyvinyl alcohol, was disclosed in U.S. Pat. No. 5,911,937 issued Jun. 15, 1999 to Hekal. Here, the mixture is solidified so that the channeling agent forms passage in the mixture through which moisture is communicable to the desiccating agent that is entrained within the mixture.

In each case, it will be realized that the volume of liquid or liquid vapor capable of being absorbed by a desiccant container is dependent on both the amount and the absorbent capacity of the desiccant material. Some most commonly used desiccating agents within the field of chemical engineering include activated charcoal, alumina, alumino silicate, calcium chloride, calcium fluoride, calcium oxide, calcium sulfate, clays, lithium chloride, molecular sieves, silica gel, starches, a zeolite, barium oxide, magnesium perchlorate, glycerin, calcium hydride, phosphoric anhydride, phosphoric acid, potassium hydroxide, sulfuric acid, ethylene glycol, barium oxide, and sodium sulfate. Of course, a desiccant agent can comprise one such desiccant or a mixture of such desiccants.

Notably, commercial grade calcium chloride may be considered to be a preferred desiccant in certain applications due to its low cost and high degree of hygroscopicity. One skilled in the art will be aware that calcium chloride, $CaCl_2$, can be prepared by dissolving limestone (i.e. a naturally occurring form of calcium carbonate) or marble chips (i.e. also a naturally occurring form of calcium carbonate) in hydrochloric acid. Commercially, however, calcium chloride is typically made from the residues of an ammonia-soda process. Advantageously, calcium chloride has been found to meet government safety standards even where used in an environment where contact with food may occur.

Notwithstanding the significant number of desiccant devices that have been developed by inventors of the prior art, one knowledgeable in the art will realize that no such device has been disclosed for use particularly in a ball pit or "sea of balls," such as one in which children and, possibly, adults can play at amusement parks, carnivals, malls, and certain restaurants such as McDonald's, Burger King, and others, and even in private applications by rental or purchase. In such seas of balls, a retaining area is provided typically in the form of a rectangular arrangement of retaining walls and a floor. The dimensions of the retaining area certainly can vary widely from a small ball pit that is just a few feet across to a large ball pit that is ten, twenty, or even more feet across and is suitable for allowing multiple persons to play therein simultaneously. Some seas of balls provide netting above the retaining walls for preventing any of the potentially thousands of ball pit balls from spilling thereover. In use, participants can jump into the ball pit or sea of balls as though it were a giant pile of leaves. Once in the ball pit, participants can move about within the enveloping sea of balls as they hide, jump, and otherwise play.

Unfortunately, as the present inventor has appreciated, the ball pit balls and other surfaces in such seas of balls often are contaminated with a variety of liquids including saliva, perspiration, and beverages. Leaving such contaminating liquids on the ball pit balls and other ball pit surfaces certainly can lead to disadvantageously unsanitary conditions. While individually drying each ball manually, such as by a drying cloth or the like, certainly is possible, it is also a cumbersome and time-consuming task. With this, an operator must either expend laborious efforts to dry the surfaces of the individual ball pit balls and the ball pit in general or forego drying those surfaces entirely thereby leading to worsening sanitary conditions.

With the foregoing in mind, the present inventor has advantageously appreciated that a ball pit ball capable of drying its own surface and indeed drying neighboring surfaces within a ball pit would be useful for removing contaminating liquids in a ball pen or ball pit and thereby assisting in maintaining such a ball pit in a sanitary condition.

SUMMARY OF THE INVENTION

In light of the above-described state of the prior art, a few objects and advantages of the present invention are worth particular mention.

Advantageously, the present invention sets forth with the broadly stated object of meeting the needs left by the prior art while providing a number of heretofore unrealized advantages thereover.

Stated more particularly, a principal object of the present invention is to provide a ball pit ball with desiccant that is capable of absorbing moisture from its own surface and from neighboring surfaces in a ball pit or the like and thereby inhibiting the growth of bacteria and fungi associated with ball pit balls within a ball pen as well as the internal surfaces of the ball pen itself.

A further object of the invention is to provide such a ball pit ball that is exceedingly rugged in use while remaining simple in construction and reasonable in cost.

An underlying object of the invention is to assist operators of ball pits and similar equipment that is in physical contact with persons to maintain the ball pit or other arrangement in a sanitary condition without expending significant efforts to do so.

Another underlying object of the invention is to promote public health by maintaining surfaces of play areas, such as ball pits and the like, in a dry and uncontaminated condition.

Undoubtedly, these and further objects and advantages of the instant invention will be obvious both to one who reviews the present disclosure and to one who has an opportunity to make use of an embodiment of the present invention for a ball pit ball with desiccant.

In accomplishing these objects, a most basic embodiment of the present invention for a ball pit ball with desiccant is founded on a generally spherical hollow outer shell that defines an open inner volume. Retained within the open inner volume of the hollow outer shell is a volume of desiccant material. Even under this most basic arrangement, the invention achieves a plurality of advantages over the prior art.

For example, the ball pit ball with desiccant according to the present invention can maintain its own inner and outer surfaces free of undesirable contaminating liquids, such as saliva, perspiration, and spilled beverages, thereby reducing the level of contamination relative to the ball pit ball. As a result, it can prevent bacteria and the like from accumulating. Furthermore, such a ball pit ball with desiccant can maintain neighboring surfaces such as adjacent ball pit balls or the walls or floor of a ball pit free of contaminating liquid. With this, the invention improves the overall sanitary status of a ball pit ball and a ball pit in general where the invention is employed.

It will be appreciated that a wide variety of desiccant materials can be used within the scope of the invention. For example, the invention could take advantage of activated charcoal, alumina, alumino silicate, calcium chloride, calcium fluoride, calcium oxide, calcium sulfate, clays, lithium chloride, molecular sieves, silica gel, starches, a zeolite, barium oxide, magnesium perchlorate, glycerin, calcium hydride, phosphoric anhydride, phosphoric acid, potassium hydroxide, sulfuric acid, ethylene glycol, barium oxide, or sodium sulfate. Furthermore, one or more of these materials could be employed in combination.

However, at present, it seems preferable to employ calcium chloride, in liquid or solid form, as the desiccant material in the open inner volume. For example, the desiccant material could comprise a calcium chloride brine. Still more preferably, the desiccant material may comprise a combination of two parts chlorine to one part calcium chloride. Of course, one skilled in the art will be able to conceive of a variety of different and additional desiccant materials that could be alternatively or additionally employed. The only true requirement is that the desiccant material be capable of absorbing liquid from the surrounding atmosphere.

The hollow outer shell may define a continuous and hollow spherical configuration whereby it presents a substantially sealed structure. The hollow shell certainly could be formed from a wide variety of materials. For example, it could be plastic, rubber or substantially any other material. Furthermore, the dimensions of hollow outer shell, and thus the ball pit ball in general, can vary widely. By way of example and not limitation, the hollow outer shell could have an outer diameter ranging the size of a standard golf ball or smaller to the size of a standard basketball or larger. However, a preferred ball pit ball will have an hollow shell with an outer diameter of between two and three inches and preferably approximately 2.6 inches, the size of a standard street hockey ball or the like.

Of course, one will appreciate that the foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF THE PREFERRED EMBODIMENTS

To assist one in better understanding and, in appropriate circumstances, practicing the present invention, certain preferred embodiments of the present invention fbr a ball pit ball with desiccant are shown in the accompanying figures and are described with particularity below.

Figure 1:
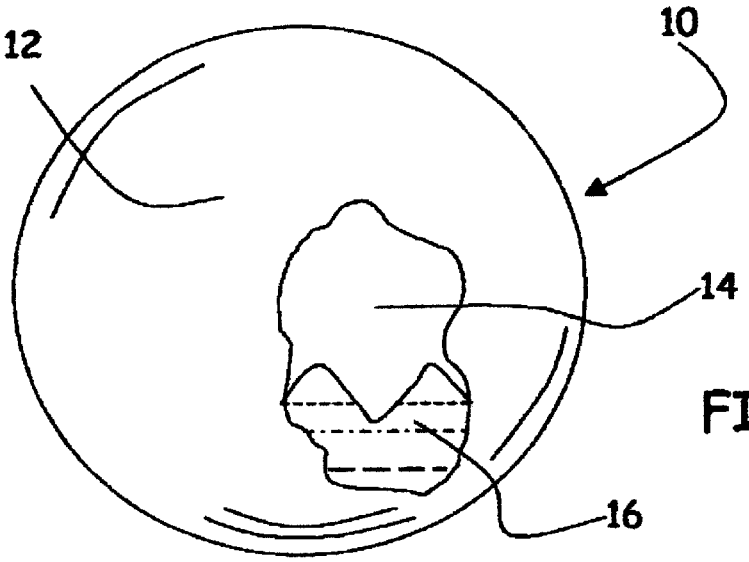
FIG. 1 is a perspective view of a partially sectioned ball pit ball with desiccant according to the present invention.

Looking more particularly to FIG. 1, one will see an embodiment of the present invention for a ball pit ball with desiccant indicated generally at 10. The ball pit ball 10 is founded on a spherical, hollow outer shell 12 that defines an open inner volume 14. Retained within the open inner volume 14 of the hollow outer shell is a volume of desiccant material 16. Of course, it will be appreciated that a wide variety of desiccant materials 16 can be used within the scope of the invention.

For example, the invention could take advantage of activated charcoal, alumina, alumino silicate, calcium chloride, calcium fluoride, calcium oxide, calcium sulfate, clays, lithium chloride, molecular sieves, silica gel, starches, a zeolite, barium oxide, magnesium perchlorate, glycerin, calcium hydride, phosphoric anhydride, phosphoric acid, potassium hydroxide, sulfuric acid, ethylene glycol, barium oxide, or sodium sulfate. Furthermore, one or more of these materials could be employed in combination to create the desiccant material 16.

For a number of reasons, calcium chloride, $CaCl_2$, is presently preferred as the desiccant material 16. One such reason is calcium chloride's low cost and high degree of hygroscopicity. Although a number of methods for forming calcium chloride would be well known to one skilled in the art, one may particularly note that calcium chloride can be prepared by dissolving limestone (i.e. a naturally occurring form of calcium carbonate) or marble chips (i.e. also a naturally occurring form of calcium carbonate) in hydrochloric acid. Commercially, however, calcium chloride is typically made from the residues of an ammonia-soda process. Calcium chloride is preferable for the further reason that it has been found to meet government safety standards even when used in an environment where contact with food may occur. Still further, calcium chloride is particularly advantageous since it acts as a fungicide.

The inventor has appreciated also that the utility of calcium chloride and possibly other desiccant materials 16 in this context can be further improved by chlorinating the calcium chloride or other desiccant material 16. With this, the desiccant material 16 will also tend to act as a bacterialstatic and bacterialcidial agent. Although a wide variety of compositions of chlorinated calcium chloride could be employed within the scope of the invention, one uniquely advantageous desiccant material 16 will comprise a mixture of two parts chlorine to one part calcium chloride.

Figure 2:
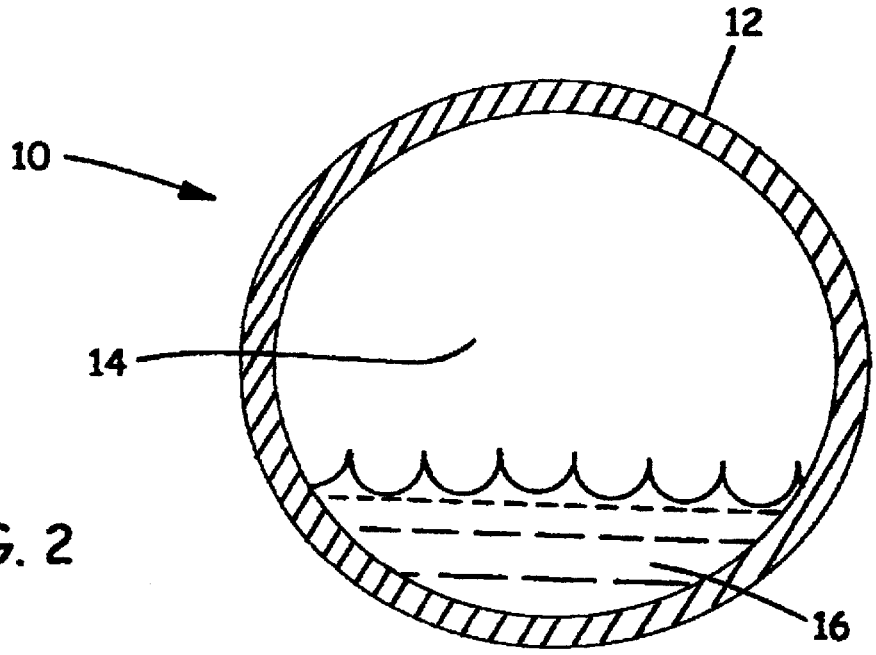
FIG. 2 is a cross-sectional view of the ball pit ball with desiccant depicted in FIG. 1.
Figure 3:
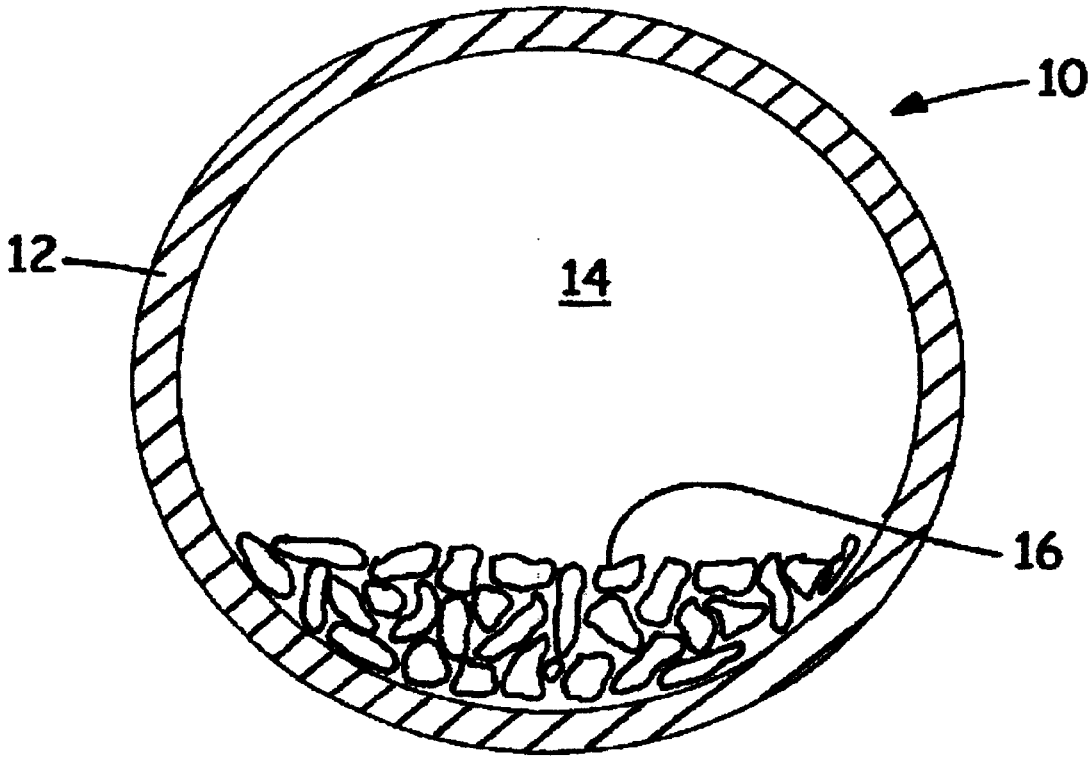
FIG. 3 is a cross-sectional view of an alternative ball pit ball with desiccant according to the present invention.

As one can see most dearly in FIGS. 1 and 2 as compared to FIG. 3, the desiccant material 16 could be in liquid or solid form. In the liquid form of FIGS. 1 and 2, the desiccant material 16 can comprise simple liquid calcium chloride or calcium chloride brine. For example, the desiccant material 16 may preferably comprise a 30% to 50% calcium chloride brine. More preferably, the desiccant material 16 will comprise a 35% to 40% calcium chloride brine, and it will most preferably comprise an approximately 37% calcium chloride brine. Advantageously, such a brine will tend to resist freezing, which may be useful where the ball pit ball 10 is employed in situations where cold temperatures may be encountered, such as outdoors.

On the other hand, in the solid form of FIG. 3 the desiccant material 16 could comprise solid members of calcium chloride. As the knowledgeable reader will appreciate and as FIG. 3 indicates, the solid members of calcium chloride typically comprise white pellets or flakes.

Notably, heat experienced by the ball pit ball 10 will help to regenerate the desiccant material 16. Of course, such heat can derive from a variety of sources such as solar heat from the sun, artificial heat from a building's heating system, heat from playing participants, or even by heat directly applied by a user. With such regeneration, the ball pit ball 10 can be employed over an extended lifetime to maintain a sea of balls in a dry and sanitary condition.

As one will realize from each of FIGS. 1, 2, and 3, the preferred hollow outer shell 12 comprises a continuous and hollow spherical configuration whereby it presents a substantially sealed structure for retaining the desiccant material 16. The outer shell 12 certainly could be formed from a wide variety of materials. For example, it could be plastic, rubber or substantially any other material. Where a desiccant material 16 in solid form is employed, it may be conceivable, although it is not expressly shown, to form the outer shell 12 with vents or other apertures for enhanced communication with the environment of the ball pit ball 10. However, it will be appreciated that, regardless of the material employed, some porosity in the outer shell 12 will tend to exist inherently without a need for vents or apertures.

It will be appreciated still further that the dimensions of hollow outer shell 12, and thus the ball pit ball 10 in general, also can vary widely. By way of example and not limitation, the hollow outer shell could have an outer diameter ranging the size of a standard golf ball or smaller to the size of a standard basketball or larger. However, a preferred ball pit ball 10 will have an hollow shell with an outer diameter of between two and three inches and preferably will have an outer diameter of approximately 2.6 inches.

In light of the foregoing, one will appreciate that the present invention achieves a number of advantages over the prior art. For example, by retaining a volume of desiccant material 16, the ball pit ball 10 is capable of absorbing moisture from its own surface and from neighboring surfaces in a ball pit or the like. With this, the ball pit ball can inhibit the growth of bacteria and fungi associated with ball pit balls 10 within a ball pen as well as the internal surfaces of the ball pen itself. Furthermore, by providing a ball pit ball 10 with a spherical outer shell 12, the ball pit ball 10 is exceedingly rugged in use while remaining simple in construction and reasonable in cost Even further, the ball pit ball with desiccant 10 assists operators of ball pits and similar equipment that is in physical contact with persons to maintain the ball pit or other arrangement in a sanitary condition without expending significant efforts to do so. With this, the ball pit ball with desiccant 10 tends to promote the public health by maintaining surfaces of play areas, such as seas of balls and the like, in a dry and uncontaminated condition. Furthermore, the ball pit ball with desiccant 10 will resist freezing whereby it can be employed effectively in outdoor applications. These and further advantages of the present invention certainly will be obvious both to one who reviews the present disclosure and to one who has an opportunity to make use of an embodiment of the present invention for a ball pit ball with desiccant 10.

From the foregoing, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments. With the foregoing in mind, the following claims are intended to define the scope of protection to be afforded the inventor, and the claims shall be deemed to include equivalent constructions insofar as they do not depart from the spirit and scope of the present invention.

It will be noted further that a plurality of the following claims express certain elements as a means for performing a specific function, at times without the recital of structure or material. As the law demands, these claims shall be construed to cover not only the corresponding structure and material expressly described in the specification but also equivalents thereof.

What is claimed is:

1. A ball pit ball with desiccant for absorbing moisture from a surface of the ball pit ball with desiccant and from neighboring surfaces in a ball pit, the ball pit ball comprising:

a generally spherical hollow outer shell;

an open inner volume defined by an inner surface of the outer shell; and a volume of desiccant material retained within the open inner volume of the outer shell wherein the desiccant material comprises a calcium chloride brine solution of approximately 30% to approximately 50% calcium chloride brine;

whereby the ball pit ball with desiccant absorbs moisture from the inner surface of the outer shell of the ball pit ball with desiccant and from neighboring surfaces in a ball pit.

2. The ball pit ball of claim 1 wherein the inner surface of the outer shell is generally spherical.

3. The ball pit ball of claim 1 wherein the calcium chloride brine comprises a solution of approximately 35% to approximately 40% calcium chloride brine.

4. The ball pit ball of claim 3 wherein the calcium chloride brine comprises a solution of approximately 37% calcium chloride brine.

5. A ball pit ball with desiccant for absorbing moisture from a surface of the ball pit ball with desiccant and from neighboring surfaces in a ball pit, the ball pit ball comprising:

a generally spherical hollow outer shell;

an open inner volume defined by an inner surface of the outer shell;

a volume of desiccant material retained within the open inner volume of the outer shell;

a volume of chlorine disposed in the open inner volume of the ball pit ball; and whereby the ball pit ball with desiccant absorbs moisture from the inner surface of the outer shell of the ball pit ball with desiccant and from neighboring surfaces in a ball pit.

6. The ball pit ball of claim 1 wherein the desiccant material comprises a liquid.

7. The ball pit ball of claim 1 wherein the desiccant material comprises a solid.

8. The ball pit ball of claim 5 wherein the desiccant material is chosen from the desiccant group consisting of activated charcoal, alumina, alumino silicate, calcium chloride, calcium fluoride, calcium oxide, calcium sulfate, clays, lithium chloride, molecular sieves, silica gel, starches, a zeolite, barium oxide, magnesium perchlorate, glycerin, calcium hydride, phosphoric anhydride, phosphoric acid, potassium hydroxide, sulfuric acid, ethylene glycol, barium oxide, and sodium sulfate.

9. The ball pit ball of claim 8 wherein the desiccant material comprises a combination of two or more of the desiccant materials from the desiccant group of claim 8.

10. The ball pit ball of claim 5 wherein the desiccant material comprises calcium chloride.

11. The ball pit ball of claim 10 wherein the calcium chloride is in liquid form.

12. The ball pit ball of claim 8 wherein the calcium chloride comprises calcium chloride brine.

13. The ball pit ball of claim 10 wherein the calcium chloride is in solid form.

14. The ball pit ball of claim 5 wherein the volume of desiccant materials comprises calcium chloride wherein the chlorine and the calcium chloride are provided in a proportion of two parts chlorine to one part calcium chloride.

15. The ball pit ball of claim 5 wherein the outer shell comprises a continuous, substantially sealed structure.

16. The ball pit ball of claim 5 wherein the outer shell has an outer diameter of between approximately 2 and approximately 3 inches.

17. The ball pit ball of claim 16 wherein the outer shell has an outer diameter of approximately 2.6 inches.

18. A ball pit ball with desiccant for absorbing moisture from a surface of the ball pit ball with desiccant and from neighboring surfaces in a ball pit, the ball pit ball comprising:

a generally spherical hollow outer shell;

an open inner volume defined by an inner surface of the outer shell; and a volume of desiccant material retained within the open inner volume of the outer shell wherein the desiccant material comprises calcium chloride;

whereby the ball pit ball with desiccant absorbs moisture from the inner surface of the outer shell of the ball pit ball with desiccant and from neighboring surfaces in a ball pit.

19. The ball pit ball of claim 18 further comprising a volume of chlorine disposed in the open inner volume of the ball pit ball.

20. The ball pit ball of claim 18 wherein the chlorine and the calcium chloride are provided in a proportion of two parts chlorine to one part calcium chloride.

* * * * *